US005549099A

United States Patent [19]

Sirand

[11] Patent Number: 5,549,099

[45] Date of Patent: Aug. 27, 1996

[54] INJECTION AND REGULATION DEVICE FOR ATMOSPHERIC GAS BURNERS FOR HEATING APPLIANCE, IN PARTICULAR OF THE INFRA-RED TYPE

[75] Inventor: Joseph Sirand, Laplume, France

[73] Assignee: Centre d'Etude et de Realisations d'Equipment et de Materiel, France

[21] Appl. No.: 279,334

[22] Filed: Jul. 22, 1994

[30] Foreign Application Priority Data

Jul. 23, 1993 [FR] France ..... 93 09379

[51] Int. Cl.[6] ..... F24C 3/04

[52] U.S. Cl. ..... 126/92 B; 126/91 R; 431/89

[58] Field of Search ..... 431/89, 121–123; 126/67, 85 R, 91 R, 92 B

[56] References Cited

U.S. PATENT DOCUMENTS

| | | | |
|---|---|---|---|
| 2,939,524 | 6/1960 | Mathis . | |
| 3,599,661 | 8/1971 | Cushman | 137/252 |
| 5,060,629 | 10/1991 | Sirand | 126/92 B |

FOREIGN PATENT DOCUMENTS

| | | |
|---|---|---|
| 535137 | 9/1931 | Germany . |
| 2151611 | 4/1973 | Germany . |
| 58088273 | 11/1981 | Japan . |

*Primary Examiner*—Larry Jones
*Attorney, Agent, or Firm*—Harold H. Dutton, Jr.; W. Charles L. Jamison; Diane F. Liebman

[57] ABSTRACT

The invention concerns an injection and regulation device for burners for heating appliances equipped with a duct (4) for an air/gas mixture and comprising a Venturi element (5). According to the invention, the means of injection include at least two injectors (13, 18) arranged with their injection nozzles staggered longitudinally and oriented so that the axis of their flux converges on the heart of the Venturi element (5). Furthermore, one of the other injectors (13), named first stage, is calibrated so that it gives an injection flow corresponding to a minimum idling rate, and is connected in such a way as to be constantly supplied with gas. In addition, the means of regulation (16) are adapted to modulate the supply to each of the other injectors (18), named second stage, so as to obtain the power required.

6 Claims, 10 Drawing Sheets

8
7
15
16
6
5
4
3
2

INJECTION AND REGULATION DEVICE FOR ATMOSPHERIC GAS BURNERS FOR HEATING APPLIANCE, IN PARTICULAR OF THE INFRA-RED TYPE

The invention concerns a device for injection and regulation between minimum power, called idling, and maximum power, called nominal, for an atmospheric gas burner for heating appliances, in particular of the infra-red type, comprising an air intake duct with an opening for the intake of air and a Venturi element. This device is furthermore of the type including means of gas injection linked to the gas supply pipes, which are placed in the air intake duct of each burner, ahead of the Venturi element, and means of regulation of the quantity of gas supplied to the means of injection. Such a device is, in addition, particularly adapted to equipping heating appliances required to operate at a low nominal pressure.

BACKGROUND AND OBJECTS OF THE INVENTION

At the present stage of technology, burners operating at low pressure, that is to say at a pressure which is in general below 500 mbar, are subject to deterioration in the quality of combustion if the pressure of the supply falls below the nominal value for which they were designed.

In fact, the balance between the dosage of the injected gas fuel and the air combustive sucked in is only satisfactory within the limits of a restricted range below the nominal pressure.

This situation prevents the use of regulation by degressive variation of the pressure of the supply down to a minimum idling and leads to the use of an "all or nothing" regulation which thus requires an electrical reignition or a pilot-light.

It should be noted that this inconvenience resulting from the impossibility of obtaining a large range of regulation through variation of nominal pressure, without bringing about deterioration in the quality of combustion, diminishes and quickly disappears when the appliances are designed to operate at pressures higher than 1 Bar. In fact, the range of efficient carburation widens when the pressure increases, and therefore, with appliances designed, for example, to operate at a pressure of 1.4 Bar for the nominal rate, one can reduce the pressure down to an idling pressure of 0.02 Bar.

The problem thus concerns "low pressure" appliances, for example an appliance operating at a nominal pressure of 350 mbar for which the intake of air sucked in and the injection of gas provided by the injector do not remain proportional over a range of pressure falling below 50% of the nominal rate.

The present invention is intended to solve this problem and its essential aim is to supply a device for injection and regulation which allows the preservation of efficient carburation of the atmospheric gas burners designed to operate at low-pressure nominal rate when one wishes to modify their rate from the nominal pressure to minimum idling.

DESCRIPTION OF THE INVENTION

In order to do this, the invention concerns a device for injection and regulation between a minimum idling power and a maximum nominal power, for atmospheric gas burners for heating appliances, the said device including means of gas injection connected to the gas supply pipes, placed in the air intake duct of each burner, ahead of the Venturi element, and means of regulation of the quantity of gas supplied to the means of injection, and characterized by the fact that:

the means of injection comprise at least two injectors, including one injector called the first stage and at least one injector called the second stage, each equipped with an injection nozzle, placed in the intake air duct ahead of the Venturi element, with their injection nozzles staggered longitudinally relative to each other, and oriented in such a way that the axis of their flux converges on a zone, called the heart of the Venturi element, situated along the axis of the air intake duct, to the right of the said Venturi element, the means of piping the gas supply to the injectors are adapted so that the first stage injector is fed continuously with a quantity of gas at least equal to the quantity of gas necessary to obtain the idling power.

the means of regulation are adapted for the cascaded modulation of the supply to each second stage injector according to the temperature regulation data, in order to obtain the desired power.

(It must be noted that by "at least" one second stage injector it is intended to include the devices of several stages, and/or devices fitted with several injectors per stage.)

The principle of the invention is thus to design several injectors used in cascade, which allows the caliber of the respective injectors to be reduced for a given quantity of gas delivered, and provides an increase in the speed of ejection of the gas flux and an improvement in the air suction effect at the mouth of the Venturi element.

In addition, the specific arrangement of these injectors staggered longitudinally with respect to each other and oriented in such a way that the gas fluxes converge on the heart of the Venturi element, is essential as far as the required result is concerned because it allows adjustment of the effects of suction created by each injector whose injection-nozzle diameters can thus be different and adapted to the combustion needs.

In practice, it has been noted that such a concept allows the modulation of the rate of a burner operating at low pressure between a maximum nominal power and a minimum idling power, without affecting the quality of combustion.

This quality of combustion was particularly noted during the operation of infra-red heating appliances, knowing that transformation into infra-red radiation of a high percentage of the calorific power involved requires, at all rates, an optimization of the proportions of the air/gas mixture.

According to a preferential design mode, one of the injectors is placed along the axis of the air intake duct, while each of the other injectors is inclined relative to the said axis in such a way as to converge on the latter.

In addition, according to another characteristic of the invention, at least one of the second stage injectors is mounted on an injector-housing tube carrying a needle with one tapered end whose cross-section is adapted to penetrate the injection nozzle, the said needle being associated with operating means capable of moving it so as to bring it either into a position for closing the gas supply of the injector, or into regulation positions where it provokes variations in flow depending on its position.

Such an arrangement makes it possible to provoke the progressive opening and closing of the injection nozzle of the second stage injector and to obtain an optimum speed of gas ejection at all rates.

According to a first advantageous version of the invention, the device includes a means of centralized regulation fixed on the main gas supply duct to several heating appliances, and able to regulate the gas pressure in the main duct according to the temperature regulation data. In this case:

each first stage injector of each burner is linked to the main duct so that the pressure of the gas supply of the said injector is that determined by the means of regulation, each second stage injector of each burner is linked to the main duct by means of a pipe on which a valve is interposed which can block the said pipe when the gas pressure in the latter falls below a predetermined threshold.

In addition, the valve equipping such a device is preferably a membrane valve consisting of two separate chambers sealed by a membrane:

one chamber with a supply intake and a supply exit forming a seat and lodging a clapper attached to the membrane and able to block the seat, one chamber housing elastic means able to draw the membrane towards the closed position where the seat is closed by the clapper.

Moreover, and still referring to this first version, at least one of the second stage injectors is advantageously mounted on an injector-housing tube carrying a needle with one tapered end whose cross-section is adapted to penetrate the injection nozzle, the injector-housing tube being associated with a valve equipped with a mobile component, and the needle being attached to the mobile component of the said valve and following its prolongation, in such a way as to bring the said needle into regulating positions where it provokes variations in flow depending on its position.

As described above, this arrangement allows the gradual opening and closing of the injection nozzles and optimizes the gas ejection speed.

According to a second advantageous version of the invention, the means of regulation are of the individual type and include a tuned shutter for regulating the gas flow, associated with each burner of the heating appliance, and linked to a main gas-supply duct.

Furthermore, as far as this second version is concerned, two different designs concerning the layout and the feeding of the injectors are envisaged according to the invention.

Thus, according to the first, preferential, set-up:

each first stage injector of each burner is linked to the associated controlled shutter, by a pipe with a diversion section branching from the said shutter, comprising an idling pre-injector of a caliber adapted to create a pressure loss so as to obtain a gas pressure corresponding to the idling position of the burner, when in the closed position of the controlled shutter.

each second stage injector of each burner is linked to the supply pipe of the first stage injector through a pipe on which a valve is set, which is able to block the said pipe when the gas pressure in the latter falls below a predetermined threshold.

The idling pre-injector allows the creation of a loss of pressure when the controlled shutter is closed, to obtain a pressure corresponding to the minimum idling rate of the associated burner. Since the gas supply enters the controlled shutter at a fixed nominal pressure, this idling pre-injector receiving this fixed pressure, thus provides a minimum pressure rate.

Besides this, this pre-injector is preferably a classic-type injector comprising a casing forming a faucet-pipe with an injection orifice at one of its ends, the said injector being positioned "head to tail" so that the gas penetrates the injection orifice.

This arrangement is aimed at avoiding the accumulation and agglomeration of micro-impurities coming from the ducts and from the town-gas itself. In fact, in the classical arrangement of injectors, that is to say with gas entering through the end of the injector opposite to the faucet-pipe, the internal profile of the said injector is conical for technological reasons for perforation of the calibrated orifice. This internal conic shape, forming a bottleneck for the micro-impurities which may gather there and pile up, often leads to the blockage of low caliber injectors.

In the arrangement adopted, if a micro-impurity manages to penetrate the idling pre-injector, it has no chance of piling up in this pre-injector after entering it through its conical extremity.

According to another preferential fitting method concerning the second version:

each first stage injector of each burner is connected to a pipe linked up ahead of the associated controlled shutter in such a way that the pressure of the gas supply of the said injector is that of the main gas-supply duct, each second stage injector of each burner is connected to a pipe linked after the associated controlled shutter.

This second arrangement constitutes a more economical solution than the one described above since it allows the blocking valves of the second stage injectors to be suppressed, this economical advantage nonetheless being obtained with a slight loss of performance at the end of the closing or at the beginning of the opening of the controlled shutter.

Taking into account the design of this version, the ejection speeds of the gas are not strictly optimized at the end of the closing or the beginning of the opening of the shutter.

However, this inconvenience can be solved by means of a device in which the controlled shutter has a shutter casing with an entry for fluids and an exit for fluids, and a clapper which can block the fluid outing under the action of a thermostatic expandable element, the said device also comprising a second stage injector mounted on an injector-housing tube carrying a needle with one tapered end whose cross-section is adapted to penetrate the injection nozzle :

the injector-housing tube being fixed to the body of the controlled shutter so as to follow the prolongation of the fluid outlet of the latter.

the needle being adjusted so as to be displaced by the clapper of the controlled shutter in the closing direction of the injection nozzle, for a displacement bringing about a decrease in the gas flow, the needle being linked to elastic means able to create a displacement of the said needle in a direction opening the injection nozzle.

Moreover, according to this second arrangement, the position of the first stage injector has to be adapted to the fact that the said injector, on the one hand, is fed by a constant gas pressure equal to the nominal pressure and, on the other hand, has to provide an injection flow which accords with the minimum idling rate.

A first advantageous solution aimed at satisfying these demands consists of building a device comprising a second-stage injector positioned along the axis of the air intake duct, and a first-stage injector at an angle relative to the said axis so as to converge towards the latter, and positioned in such a way that its injection nozzle is staggered longitudinally and forwards compared with that of the second stage injector.

Another solution is to build a device with a second-stage injector placed along the axis of the air intake duct, and a first-stage injector at an angle relative to the said axis in order to converge on the latter, and positioned so that its injection nozzle is staggered longitudinally and backwards compared with that of the second stage injector, the said arrangement thus comprising an obstacle set so as to intercept the gas flow delivered by the first-stage injector.

This second solution, which involves adjusting the speed of ejection of the gases by putting an obstacle in the path of the gas jet in order to slow down its speed and, by reducing it, to modify the quantity of air brought in, has been shown to be more advantageous.

In fact, the obstacle can be placed in a very simple way, for example by using a screw sticking out inside the air intake duct, and its position can be easily tuned until the optimum operating conditions are obtained.

BRIEF DESCRIPTION OF THE DRAWINGS

Other characteristics, aims and advantages of the invention will become apparent from the detailed description which follows, referring to the diagrams in the appendix which represent five preferential settings as non-restrictive examples. In these diagrams, which are an integral part of the present description.

DESCRIPTION OF PREFERRED EMBODIMENTS

The injection and regulation devices corresponding with the invention are represented in the figures linked with infra-red heating appliances 1 as used in the farming sector for heating buildings for rearing animals.

Figures 2, 3:
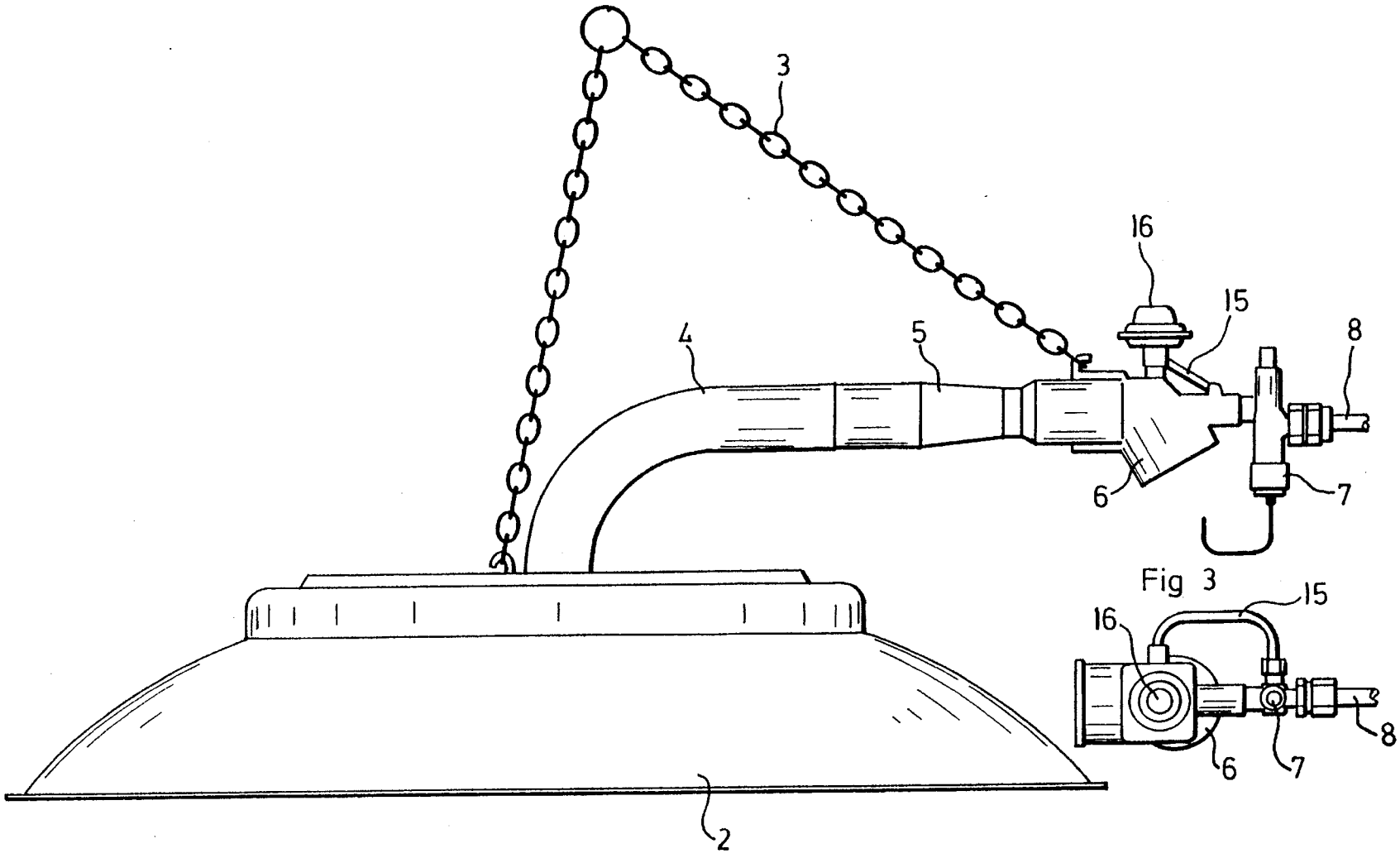
FIG. 2 is a lateral view of an infra-red heating installation of the type equipping the heating installation represented in FIG. 1, but with an injection device conforming to the invention.
FIG. 3 is a partial view from above representing the air-intake ducts and the gas supply pipes of the heating appliance represented in FIG. 2.

As represented in FIG. 2, such heating appliances 1 include first of all a reflector 2 in the form of a cupola designed to be suspended over the chosen place, for example with the aid of a chain 3, and housing the elements for diffusion, combustion and radiation (such elements, not shown, can in particular belong to the sort described in U.S. Pat. No. 5,060,629 in the name of the applicant).

Each heating appliance 1 includes, in addition, a supply line for an air/gas mixture composed of an angled duct 4 fitted, in a classical way, with a Venturi element 5 and an entry vent 6 for the air for primary combustion.

This heating appliance 1 also includes, in a classical way, a safety valve 7 plugged into a gas supply duct 8 of the said appliance, whose exit is linked to the means of injection of gas which are placed ahead of the Venturi element 5 and described below.

(The elements described above being common to each variant, they will be given the same numeric references in the rest of the description hereafter.)

According to the invention, such heating appliances 1 are designed to operate at a low pressure nominal rate with the possibility of modulating their rate down to the minimum idling rate.

However, according to the variants represented, the means of regulation allowing this modulation are either centralized (FIGS. 1, 2, 3, 4, 9, 10) and therefore the same for several heating appliances, or are individual and fitted with a controlled shutter for regulating the gas flow fixed to each appliance (FIGS. 5 to 8).

The factor common to these different variants is that:

the means of injection consist of two injectors, respectively one first-stage injector and one second-stage injector, both fitted with injection nozzles, fixed in the duct 4, ahead of the Venturi element 5, with their injection nozzles staggered longitudinally and oriented so that the axis of this flux converges on the heart of the Venturi element 5, one of the said injectors following the axis of the duct 4, and the other injector being at an angle to the said axis.

the first stage injector is calibrated to give an injection flow suitable for the minimum idling pressure.

The second stage injector is calibrated so as to give an injection flow which, in combination with the first stage injector, produces the totality of the nominal power of the appliance when the supply pressure reaches its nominal value.

The means of regulation are adapted to modulate the feed to the second stage injector so as to obtain the power desired.

Figure 1:
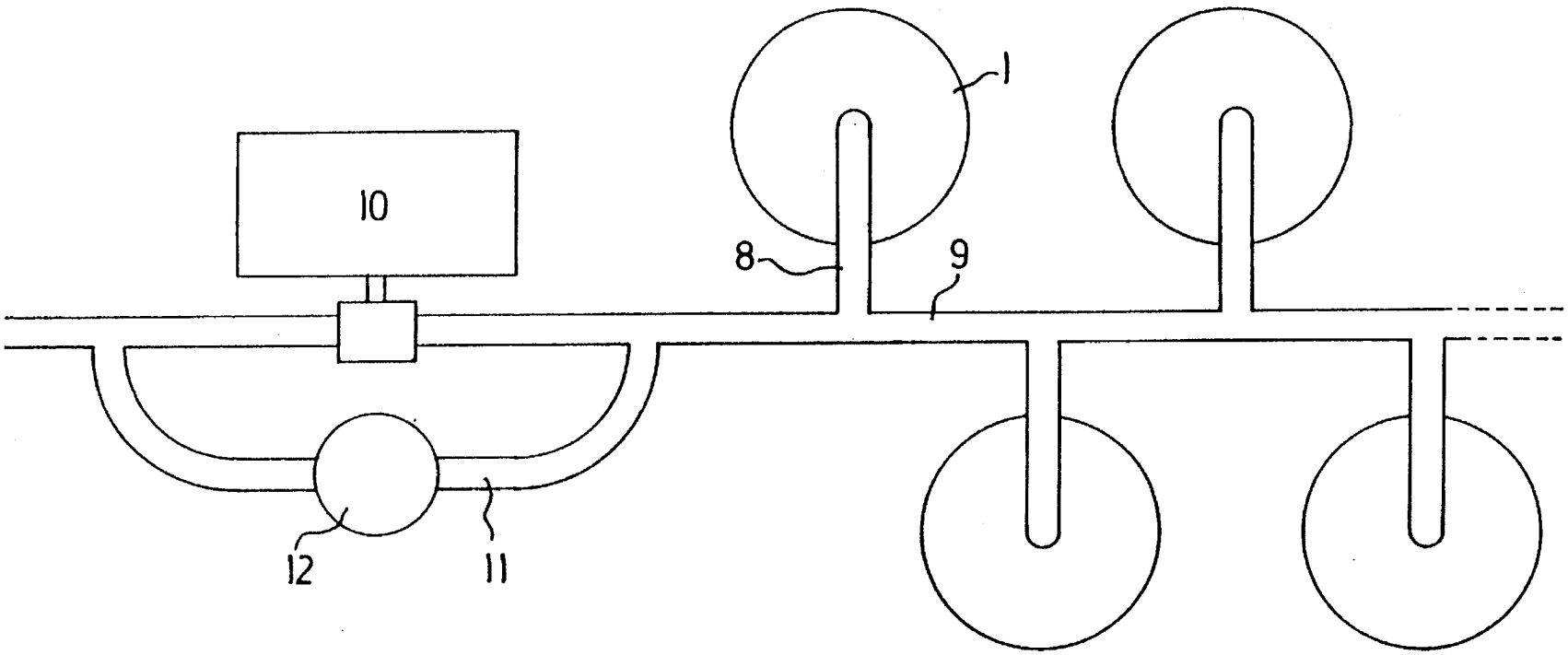
FIG. 1 is a diagram in principle of a heating installation consisting of several heating appliances of the infra-red type, and with centralized means of regulation, such as that concerned by the invention.

In the first instance, FIG. 1 represents an installation with means of centralized regulation, consisting of a primary supply duct 9 to which are attached gas supply pipes 8 for the heating appliances.

These means of centralized regulation are composed, in a classical way, of a control board 10 with a thermostatic shutter or a power reducing valve operated by a servo motor, the whole being arranged in parallel relative to a diversion duct 11 on which an idling reducing valve is fixed 12.

Figure 4:
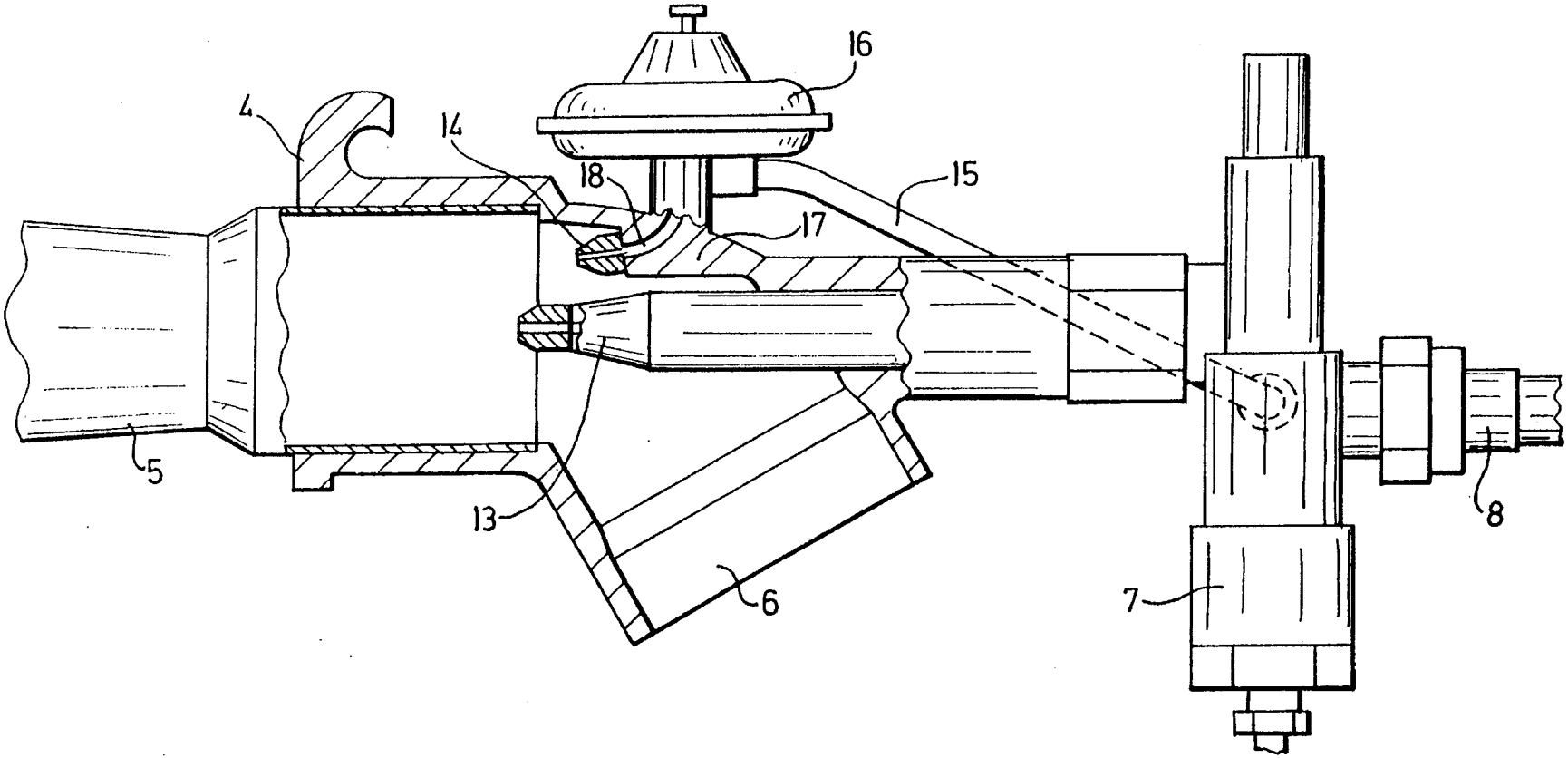
FIG. 4 is a schematic longitudinal view, partly cut by a vertical axial plane, of the means of air and gas supplies of the heating appliance of FIG. 2.

According to the mouting represented in FIGS. 2 to 4, each heating appliance comprises a first stage injector 13 linked directly to the outlet of the safety valve 7 and fitted along the axis of duct 4.

In addition, this heating appliance comprises a second stage injector 14 inclined at an angle compared to the axis of the duct 4 and set back compared to the first stage injector 13. This injector 14 is linked to a second outlet of the safety valve 7 through a diversion duct 15 on which is mounted a membrane valve 16. This second stage injector 14 is, moreover, attached directly to an internal excrescence 17 in the duct 4, pierced with a bore 18 to bring in the gas.

Figure 12:
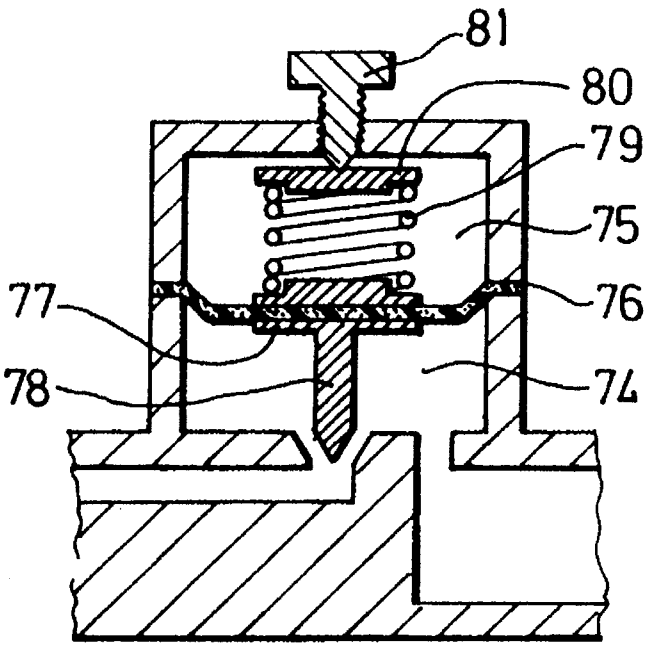
FIG. 12 is a longitudinal section in principle of a membrane valve conforming with the invention as mounted on the heating appliances represented in FIGS. 4 and 5.

The membrane valve 16, whose design will be described later in reference to FIG. 12, is classically adapted to block the diversion duct 15 when the gas pressure in the latter drops below a predetermined threshold.

Such an embodiment is particularly adapted to heating installations where the nominal supply pressure is above 100 mbars, with a possible variation in pressure of 20 mbars from the nominal power.

In addition, according to this embodiment, the first stage injector 13 is calibrated to give an appropriate injection flow at a pressure of 20 mbars.

The embodiments represented in FIGS. 5 to 8 concern heating appliances with their own element for individual regulation, consisting of a thermostatic shutter whose design will be described later with reference to FIG. 11.

Figure 5:
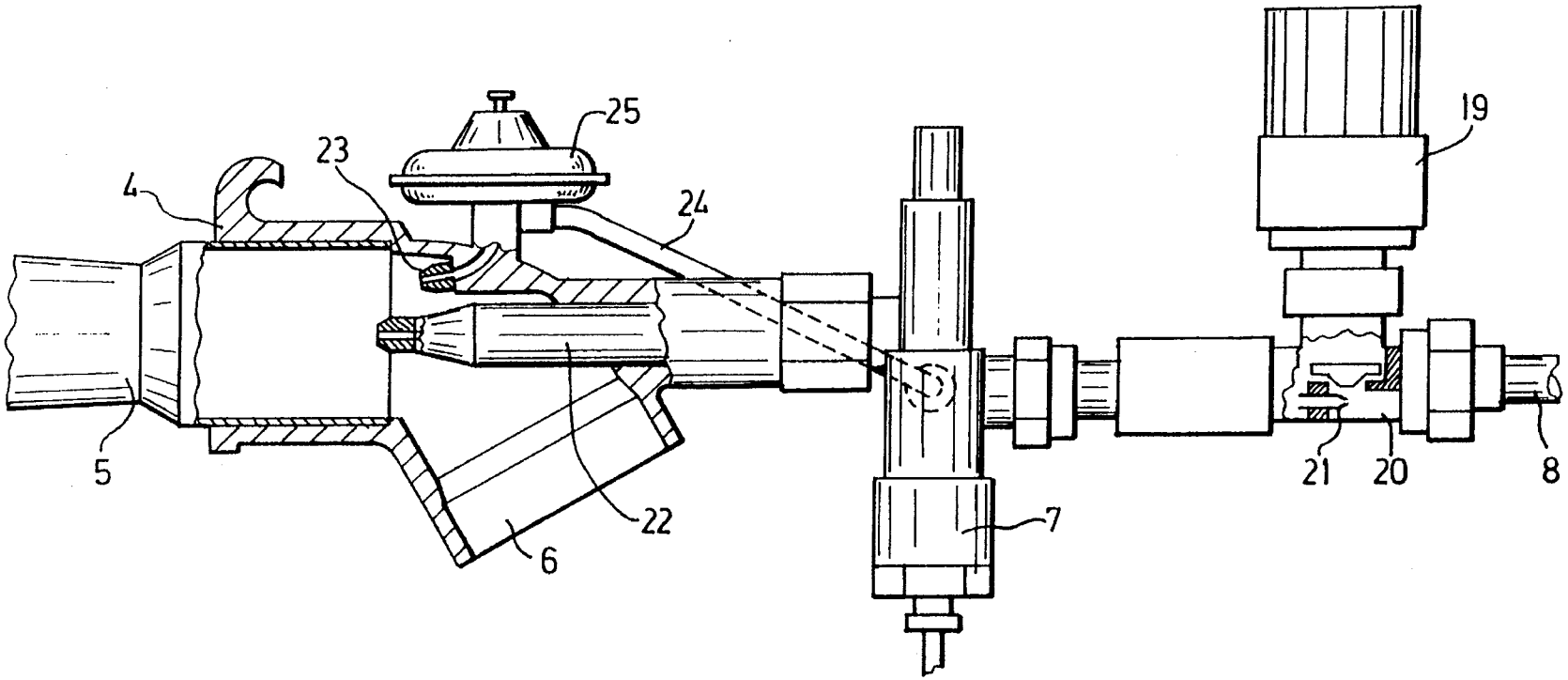
FIG. 5 is a schematic longitudinal view, partly cut by a vertical axial plane, of the means of air and gas supplies conforming with the invention linked to an infra-red heating appliance equipped with individual means of regulation.

According to the first embodiment represented in FIG. 5, the thermostatic shutter 19 is placed ahead of the safety valve 7. Parallel to this thermostatic shutter 19, the gas supply duct 8 has a diversion branch 20 fitted with an idling pre-injector 21.

Such an idling pre-injector 21 is designed to create a loss in pressure when the thermostatic shutter 19 is closed, in order to obtain a pressure corresponding to the minimum idling rate. The pre-injector 21 also incorporates a classical injector positioned "head to tail" so that the gas penetrates through its injection orifice.

According to this embodiment, the injectors are placed in an identical way to those of the heating appliance in FIG. 4 : the first stage injector 22 is linked directly to the safety valve 7 and extends along the axis of the duct 4, and the second stage injector 23 is set an angle to the said axis, and linked to the safety valve 7 by a branch pipe 24 fitted with a membrane valve 25.

Such an embodiment is particularly adapted to heating installations whose nominal supply pressure is above 150 mbars, with a possible variation of 20 mbars from the nominal power.

Furthermore, the first stage injector 22 is calibrated to give an injection flow corresponding to the pressure produced by the pre-injector 21.

Figure 6:
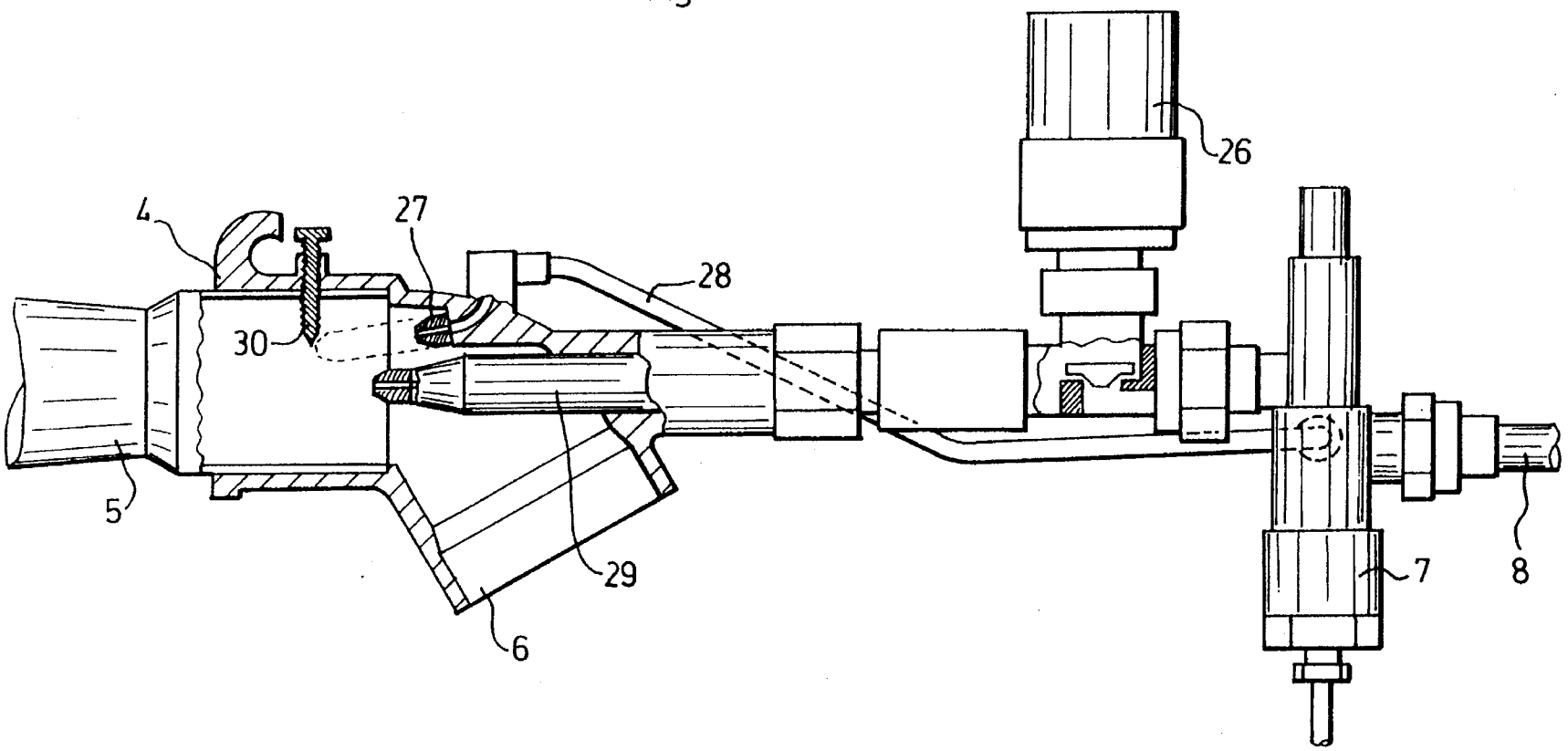
FIG. 6 is a schematic longitudinal view, partly cut by a vertical axial plane, of a variant of the means of air and gas supplies conforming with the invention, linked to an infra-red heating appliance equipped with individual means of regulation.

According to the second embodiment, shown in FIG. 6, the thermostatic shutter 26 is placed after the safety valve 7.

The first stage injector 27 is directly linked to one of the outings of the safety valve 7 by a branch pipe 28 and is placed in the position of the second stage injector (14 or 23) of the preceding versions, that is to say at an angle to the axis of the duct 4 and set back compared with the second-stage injector 29 which itself lies along the axis of the duct 4.

In addition, since the first stage injector 27 is fed with a fixed gas pressure corresponding to the nominal pressure, an obstacle 30, consisting of a screw sticking out inside the duct 4, is placed so as to intercept the gas flow delivered by this injector, with the aim of reducing the speed of the gas jet and diminishing the quantity of air drawn in by the latter.

It should noted that in another variant, as shown by the dotted lines, the first stage injector 27 can be adapted to be of such a length that its injection nozzle is positioned in front of that of the second stage injector 29. In this case, obstacle 30 is not needed.

Such an embodiment is particularly adapted to heating installations whose nominal supply pressure is between 100 and 150 mbars, and presents an especially economical solution.

Figure 7:
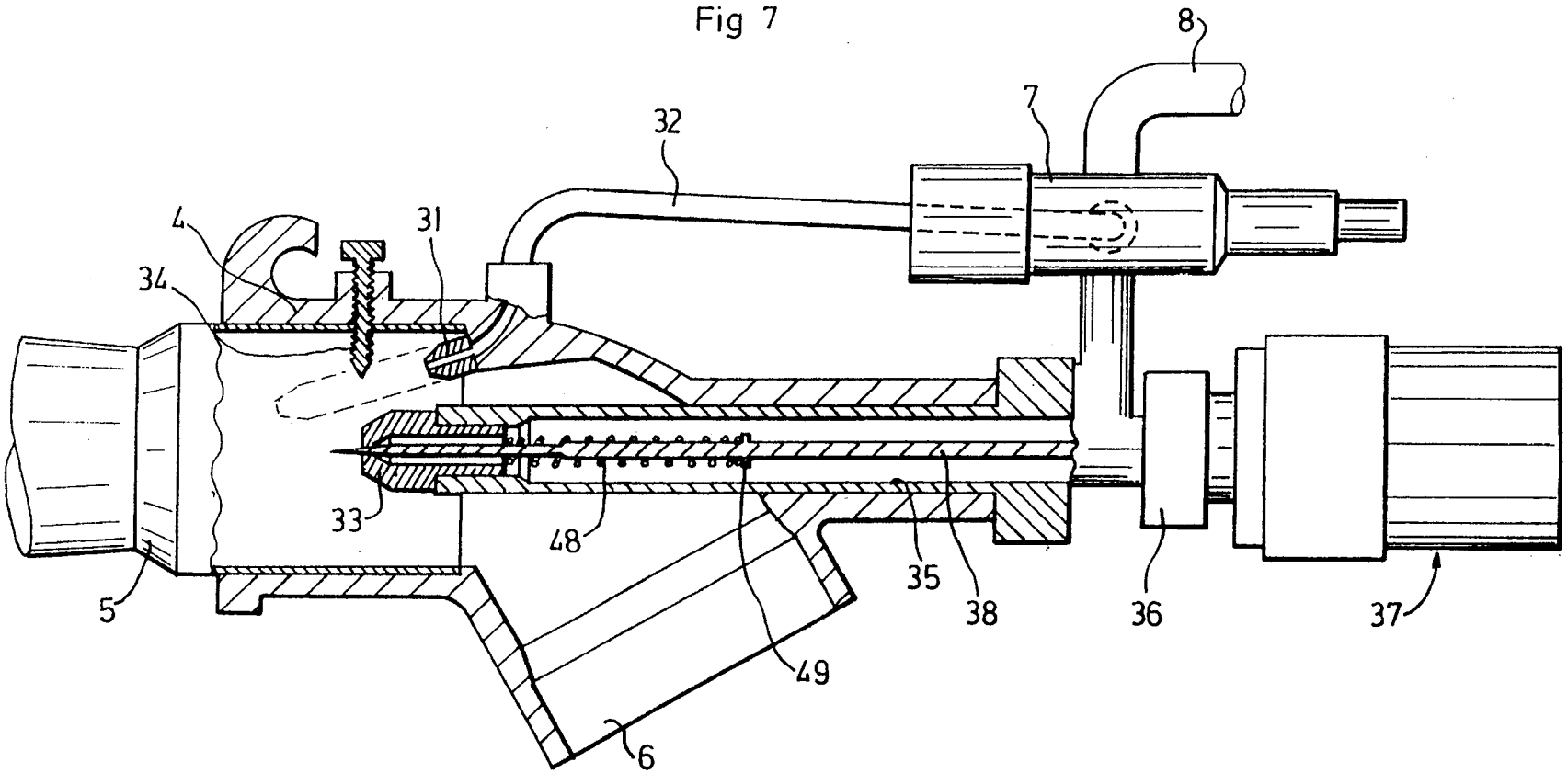
FIG. 7 is a schematic longitudinal view, partly cut by a vertical axial plane, of a second variant of the means of air and gas supplies conforming with the invention, linked to an infra-red heating appliance equipped with individual means of regulation.

According to the third version shown in FIG. 7, the first stage injector 31 is similar to that of the preceding embodiment, that is to say linked directly to the safety valve 7 by a branch pipe 32 set at an angle to the axis of the duct 4, and set back compared to the second stage injector 33, and associated with an obstacle 34 which intercepts the gas flux.

Figure 8:
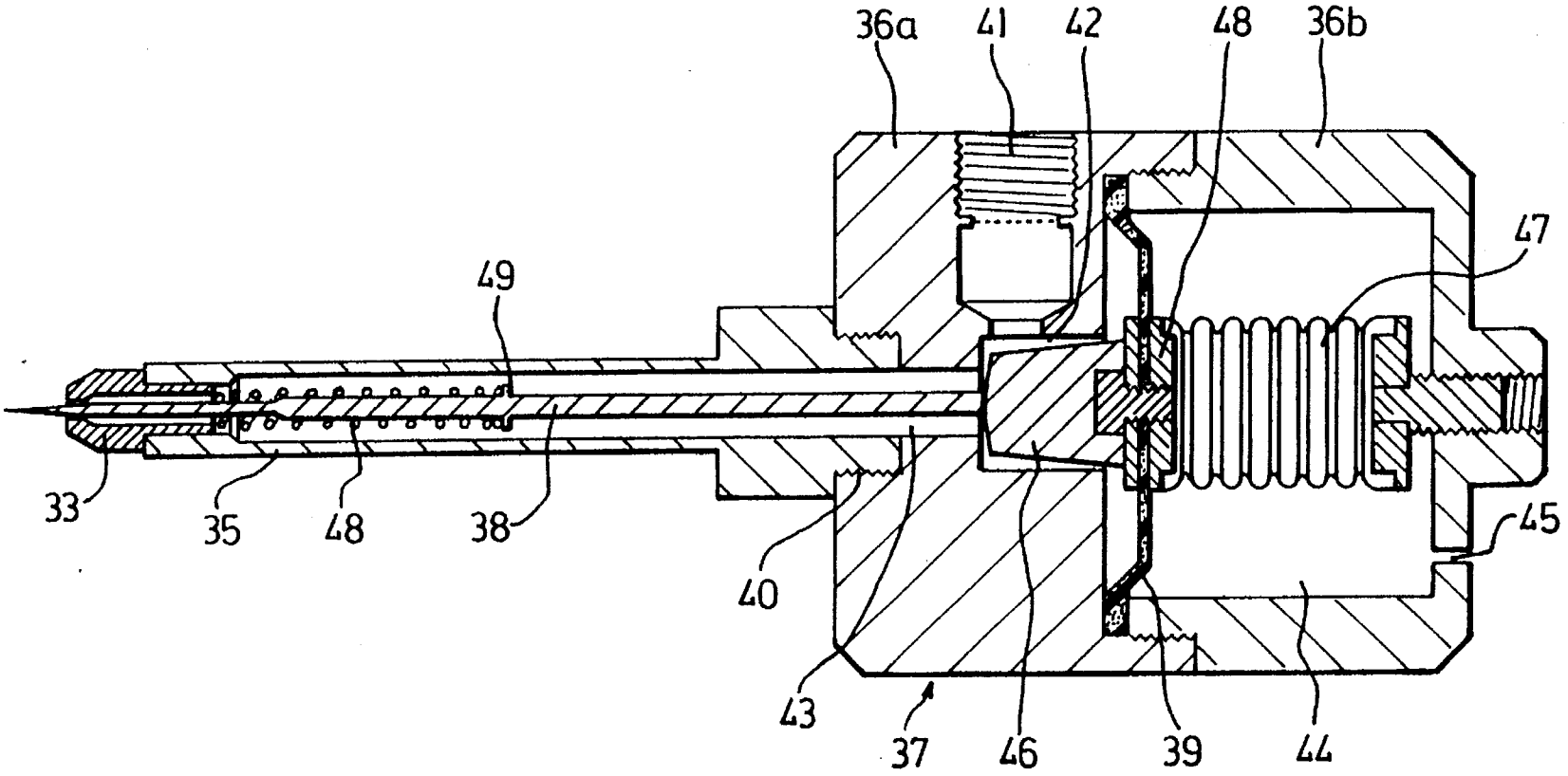
FIG. 8 is a longitudinal section through a vertical axial plane representing the needle injector and the thermostatic shutter of the means of supply of FIG. 7.

The second stage injector 33 extends along the axis of the duct 4 and is mounted at the end of the injector-housing tube 35, and is fixed at its other end to the body 36 of the thermostatic shutter 37, as shown in FIG. 8.

This injector-housing tube 35 also carries a needle 38 with one tapered end whose cross-section is adapted to penetrate the injection nozzle of the injector 33, in such a way that it creates variations in the flow depending on the relative position of the said tapered end compared with the said injection nozzle. This needle 38 is also of an appropriate length so that the end opposite to the tapered end goes into the prolongation of the injector-housing tube 35.

The thermostatic shutter 37 itself has a shutter body divided into two halves **36*a* and 36*b*, defining an internal annular groove which houses the outside edge of a membrane 39**.

One of these halves **36*a* has a frontal threaded orifice 40 for fixing the injector-housing tube 35, and a lateral threaded orifice 41 for attaching the thermostatic shutter 37 to the safety valve 7**.

This half of the body **36*a* also has a seat 42 which is coaxial with the frontal threaded orifice 40 and communicates with the said frontal orifice by means of a bore 43** leading to the respective back plates of the said orifice and seat.

The second half of the body **36*b* itself delimits an internal chamber 44 which possesses an air vent 45** which ensures that the said chamber remains at atmospheric pressure.

The thermostatic shutter 37 also possesses a clapper 46 whose shape is adapted to operate in conjunction with the seat 42 and a classical bellows 47 with expandable fluid placed on both sides of the membrane, and supported against a floating part 48 attached to the said membrane.

This thermostatic shutter 37 and the injector-housing tube 35 are mounted as shown in FIG. 8 so that the needle 38 comes into contact with the clapper 46 and moves in a direction so as to block the injection nozzle when the bellows 47 extends.

The opposite movement, to increase the cross-section of the gas flow of the injection nozzle is obtained by means of a spring 48 mounted around the needle 38, and resting against an internal shoulder of the injector-housing tube 35, and a collar 49 attached to the said needle.

Such an embodiment is particularly adapted to heating installations whose supply pressure is of the order of 100 mbars, equipped with heating appliances of high calorific capacity (5,000 to 10,000 Watts). Furthermore, the gradual opening and closing of the injection nozzle of the second stage injector 33 provides the possibility of obtaining an optimum gas speed at all rates.

Figure 9:
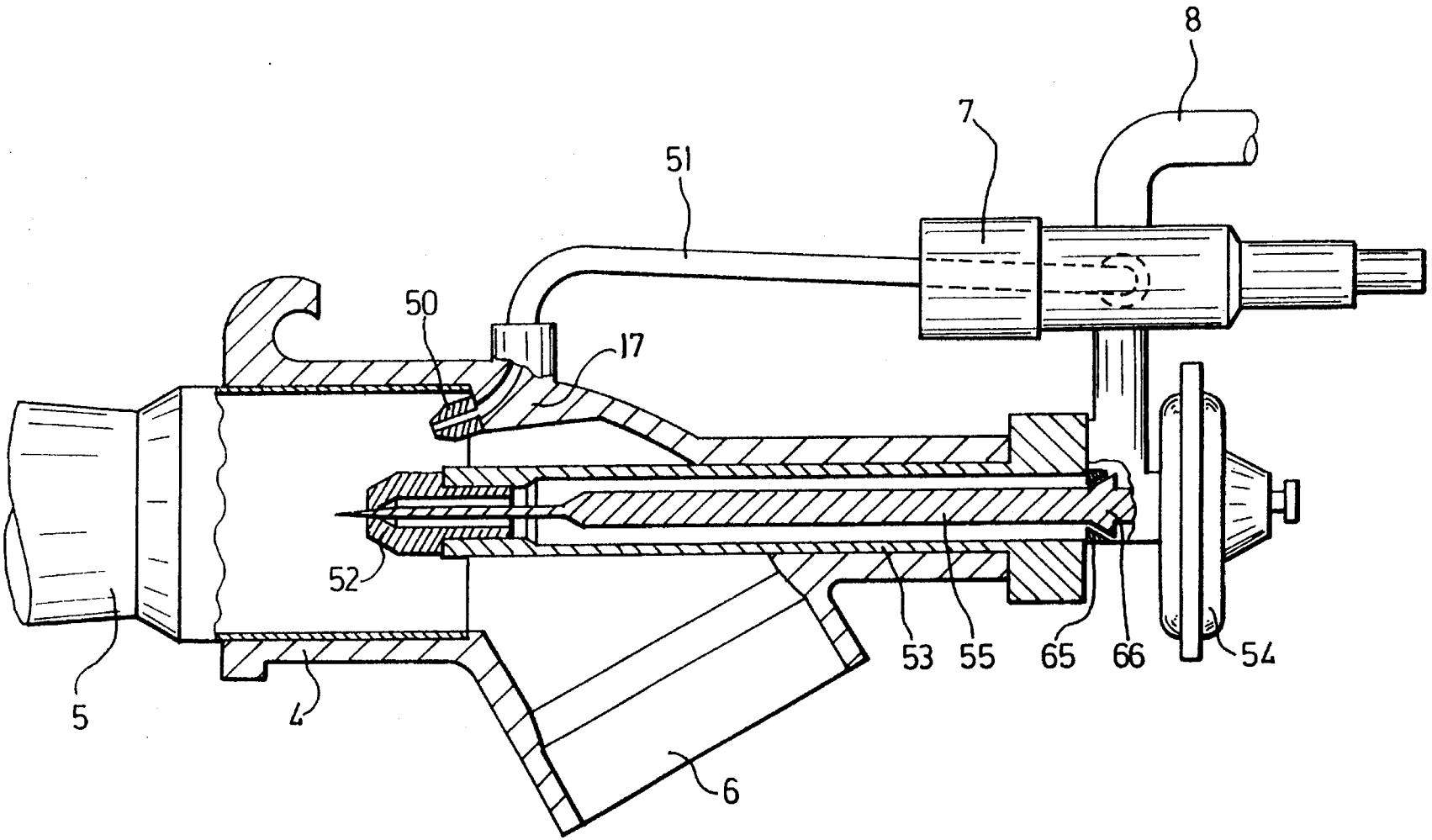
FIG. 9 is a schematic longitudinal view, partly cut by a vertical axial plane, of a variant of the means of air and gas supplies equipping a heating installation with centralized means of regulation.
Figure 10:
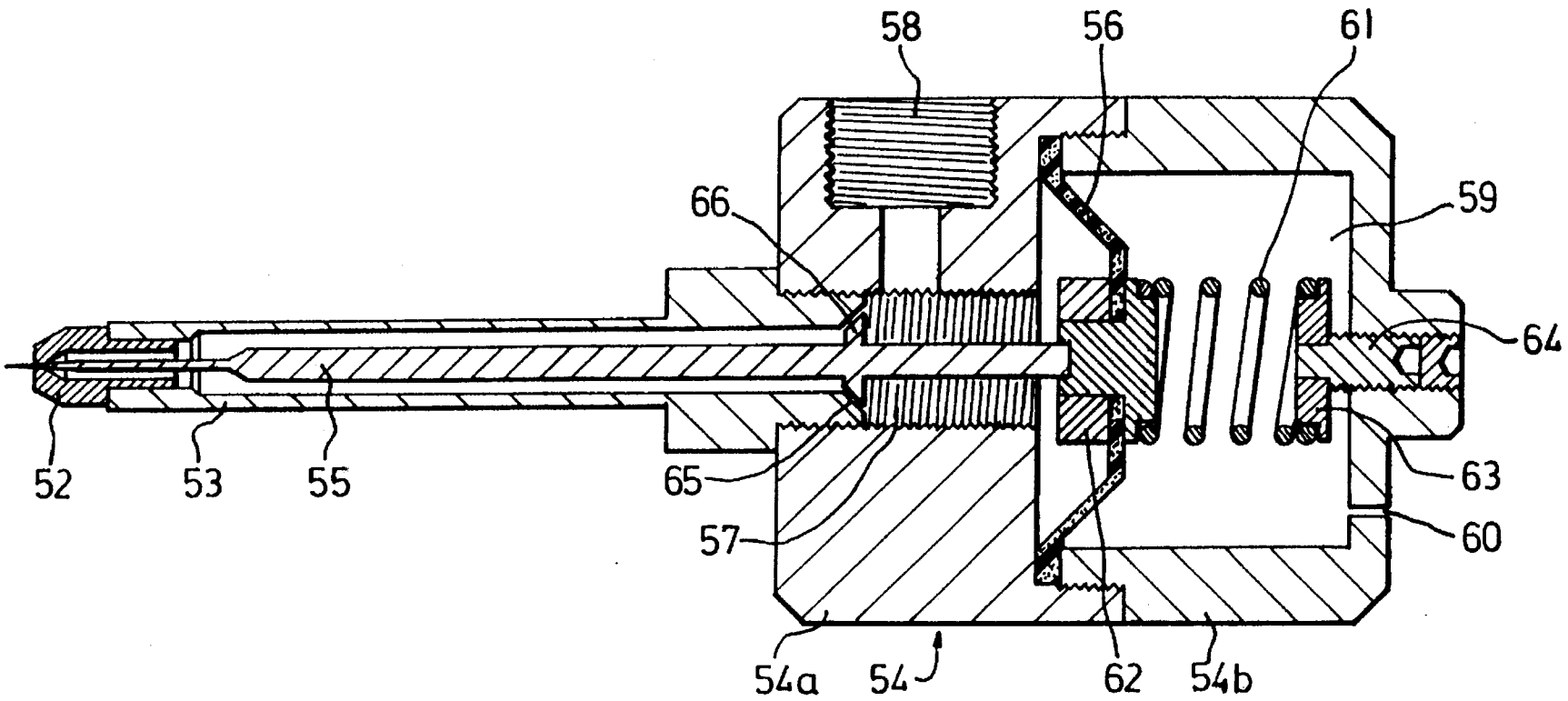
FIG. 10 is a longitudinal section through a vertical axial plane representing the needle injector and the membrane valve of the means of supply of FIG. 9.

The embodiment shown in FIGS. 9 and 10 concerns a heating appliance equipping a heating installation fitted with centralized means of regulation such as the one drawn in FIG. 1.

This heating appliance consists of a first stage injector 50 linked directly to the safety valve 7 by a branch pipe 51, and fixed on the internal excrescence 17 of the duct 4, so as to extend along an axis inclined at an angle to the axis of the said duct.

The second stage injector 52 itself extends along the axis of the duct 4, ahead of the first stage injector 50, and is mounted on the end of the injector-housing tube 53, fixed at its other end on the body of a membrane valve 54 as shown in FIG. 10.

This injector-housing tube 53 also carries a needle 55 with one tapered end whose cross-section is adapted to penetrate the injection nozzle of the injector 52, in such a way that it creates variations in the flow depending on the relative position of the said tapered end compared with the said injection nozzle. This needle 55 is also of an appropriate length so that the end opposite to the tapered end goes into the prolongation of the injector-housing tube 53.

The membrane valve 54 itself has a shutter body divided into two halves 54*a* and 54*b*, defining an internal annular groove which houses the outside edge of a membrane 56.

One of these body halves 54*a* has a frontal threaded orifice 57 for fixing the injector-housing tube 53, and a lateral threaded orifice 58 for attaching the membrane valve 54 to the safety valve 7.

The second half of the body 54*b* itself delimits an internal chamber 59 with an air vent 60 which ensures that the said chamber remains at atmospheric pressure. The frontal threaded orifice 57 opens into this chamber.

The membrane valve, in the classical way, has a spring 61 lodged in the chamber 59 supported at one end on a floating part 62 attached to the membrane 56, and at its other end on a mobile stop 63 whose position is controlled by an adjusting screw 64.

This membrane valve 54 and the injector-housing tube 53 are set so that the needle 55 is attached to the floating part 62 and is displaced longitudinally according to the pressure of the gas supply controlled by centralized means of regulation.

Furthermore, the injector-housing tube 53 creates a seat 65 and the needle 55 has a collar in the form of a valve 66 which is able to block the seat 65 in the fully-open position of the spring 58 corresponding to a gas supply pressure below the pre-tuned threshold for closing the membrane valve 54.

As in the embodiment described above, this version is particularly adapted to heating installations whose supply pressure is of the order of 100 mbars, equipped with high-capacity heating appliances.

Figure 11:
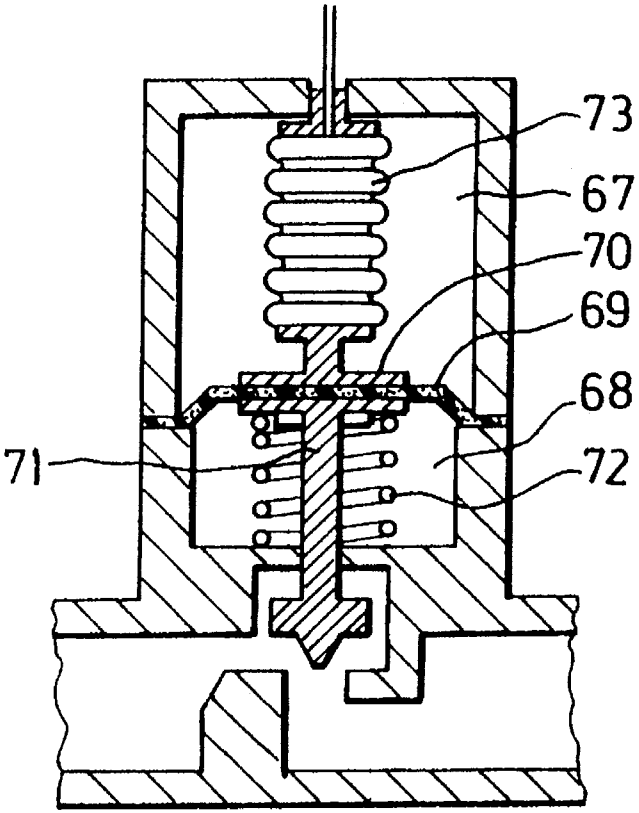
FIG. 11 is a longitudinal section in principle of a thermostatic shutter conforming with the invention as mounted on the heating appliances represented in FIGS. 5 and 6, and equipped with individual means of regulation.

FIG. 11 is a diagram in principle of the thermostatic shutters 19 and 26, equipping the devices represented in FIGS. 5 and 6.

This thermostatic shutter is divided into two chamber 67 and 68 by a membrane 69 attached at its edge to the body of the shutter, and carrying a floating part 70.

In the classical way, this shutter comprises on the one hand a clapper 71 supported against the floating part 70 and drawn in the opening direction of the said shutter by a spring 72, and on the other hand by a bellows 73 with expandable fluid supported against the opposite face of the floating part 70 in order to draw the clapper 71 in a closing direction when it is extended.

FIG. 12 is itself a diagram in principle of the membrane valves 16 and 25 equipping the devices represented in FIGS. 4 and 5.

This membrane valve is divided into two chambers 74 and 75 by a membrane 76 carrying a floating part 77.

Inside one of the chambers 74 is a clapper 78 attached to the floating part 77, while the other chamber 75 houses a spring 79 with one end supported against the floating part 77 and the opposite end against a mobile stop 80 whose position is controlled by a tuning screw 81.

I claim:

1. A combustion gas regulator-injector device for injecting gas to and regulating the power of a gas powered infrared heating appliance between a minimum idle power level and a maximum nominal power level and including a conduit for supplying a combustion gas under variable pressure, an air intake duct including an air intake vent and a Venturi member, said device further comprising gas injection means including a first stage injector and at least one second stage injector, each of said injectors having injector nozzles and connected to said gas supply means, said first and second stage injectors being spaced along said air intake duct and oriented so that gas flow therefrom is directed at the reduced pressure area of said Venturi member, said conduit supplying a quantity of gas to said first stage injector sufficient to maintain said minimum idle power level, and supplying a quantity of gas to said second stage injector and control means for modulating the supply pressure to said second stage injector for regulating the power output of said appliance according to a desired power level.

2. A combustion gas regulator-injector device as in claim 1 and wherein said first stage injector comprises one injector member and said second stage injector comprises a plurality of injector members.

3. A combustion gas regulator-injector device as in claim 2 and wherein one of said injector members is oriented along a longitudinal axis of said air intake duct and the other of said injector members are at an angle convergent with said axis.

4. A combustion gas regulator-injector device as in claim 3 and wherein at least one of said second stage injector members comprises an injector housing having a nozzle at one end thereof and a tapered needle concentrically mounted therein, and drive means for displacing said needle for varying the flow of gas through said nozzle.

5. A combustion gas regulator-injector device as in claim 4 and including means for sensing the temperature of the area to be heated and operatively connected to said drive means for thereby controlling the flow of gas, and a valve member for blocking the flow of gas when the gas pressure falls below a predetermined pressure.

6. A combustion gas regulator-injector device as in claim 5 and wherein said valve member comprises two chambers separated by a membrane, one of said chambers having a feed entrance and a feed exit forming a seat, and housing a clapper attached to said membrane and capable of blocking the seat, the other of said chambers having elastic means for moving the membrane in the direction for closing the seat with the clapper.

* * * * *